US005617193A

United States Patent [19]

Ban et al.

[11] Patent Number: 5,617,193

[45] Date of Patent: Apr. 1, 1997

[54] IMAGE TRANSFERRED SHEET CONVEYING GUIDE FOR USE IN AN IMAGE FORMING APPARATUS

[75] Inventors: Keiji Ban; Tetsuro Tomoe; Masami Fuchi; Hiroaki Tsuchiya; Osamu Yoshimura; Shinichi Tanaka, all of Osaka, Japan

[73] Assignee: Mita Industrial Co., Ltd., Japan

[21] Appl. No.: 276,784

[22] Filed: Jul. 18, 1994

[30] Foreign Application Priority Data

Jul. 29, 1993 [JP] Japan ..... 5-187729

[51] Int. Cl.[6] ..... G03G 15/14

[52] U.S. Cl. ..... 399/316; 399/361

[58] Field of Search ..... 355/315, 316, 355/308, 309, 245, 271, 277, 274, 282, 290, 285; 118/653, 657, 658

[56] References Cited

U.S. PATENT DOCUMENTS

| | | | |
|---|---|---|---|
| 3,824,012 | 7/1974 | Iizaka et al. | 355/274 |
| 3,880,119 | 4/1975 | Fraser | 118/657 X |
| 4,572,647 | 2/1986 | Bean et al. | 355/245 X |
| 5,138,396 | 8/1992 | Satou et al. | 355/308 |
| 5,159,394 | 10/1992 | Jinzai | 355/290 |
| 5,166,737 | 11/1992 | Tomita | 355/308 |
| 5,285,245 | 2/1994 | Goto et al. | 355/271 |
| 5,365,322 | 11/1974 | Hamada et al. | 355/308 X |
| 5,477,314 | 12/1995 | Tsuchiya et al. | 355/308 |

FOREIGN PATENT DOCUMENTS

| | | | |
|---|---|---|---|
| 1-292376 | 11/1989 | Japan | 355/315 |

*Primary Examiner*—Shuk Yin Lee

*Attorney, Agent, or Firm*—Beveridge, DeGrandi, Weilacher & Young, L.L.P.

[57] ABSTRACT

A conveying guide for conveying a sheet onto which an image has been transferred is made of a synthetic resin having a resistance higher than the resistance of the transfer sheet. The upstream side end of the upper surface of the conveying guide is located sufficiently lower than the position at which the sheet is separated from the surface of the photoreceptor drum. With these arrangements, the charging of the conveying guide due to the friction between the sheet and the guide is prevented, thereby restraining the image quality deterioration.

10 Claims, 3 Drawing Sheets

IMAGE TRANSFERRED SHEET CONVEYING GUIDE FOR USE IN AN IMAGE FORMING APPARATUS

BACKGROUND OF THE INVENTION

1. Field of the Invention

The present invention relates to an image forming apparatus such as an electrographic copying machine, a facsimile machine and a printer, and more particularly, to an improvement of a conveying guide for conveying a sheet onto which an image has been transferred.

2. Description of the Prior Art

In an image forming apparatus in which a toner image formed on the surface of a photoreceptor is transferred onto a transfer sheet, generally, a charging section, an exposure section, a development section and a transfer section are arranged in this order in a direction of rotation of the photoreceptor drum which rotates in one direction. After charged at the charging section, the drum surface is exposed at the exposure section to thereby form an electrostatic latent image in accordance with image information. Then, at the development section, charged toner is attached to the electrostatic latent image to develop the latent image into a toner image, and at the transfer section, the toner image formed on the drum surface is transferred onto the transfer sheet conveyed to the transfer section in synchronism with the rotation of the drum.

Referring to FIG. 1, there is shown the structure of a conventional transfer section. In the transfer section, a transfer roller 52 serving as a charge supplying means is provided below a photoreceptor drum 51 so as to face to the photoreceptor drum 51. Between the drum 51 and the transfer roller 52, a sheet path R' is provided so that a transfer sheet P is conveyed in a direction corresponding to the direction of rotation of the drum 51 shown by an arrow r'.

The sheet P conveyed along the path R' enters the gap between the drum 51 and the transfer roller 52, and then, electrostatically adheres to a transfer area on the drum surface. To the transfer roller 52, a voltage is applied of a polarity reverse to that of the toner image on the drum surface. The charged toner forming the toner image is attracted by the voltage, so that the toner image is transferred onto the surface of the sheet P. After the transfer, the sheet P is separated from the drum surface, for example, by curvature separation, and conveyed to a non-illustrated fixing section along a conveying guide 53 provided in the downstream side of the gap between the drum 51 and the transfer roller 52.

In this arrangement, normally, the conveying guide 53 supports the sheet P at its reverse surface, and an upper surface 53*a* along which the sheet P is conveyed is made of a highly insulating synthetic resin material. The upstream side half of the upper surface 53*a* gently declines in the sheet conveying direction. The downstream side half thereof is substantially level. On the upper surface 53*a* of the conveying guide 53, a plurality of guide ribs 54 are formed along the path R' to be parallel to one another. The contact friction is reduced since the reverse surface of the sheet P is partly supported by the guide ribs 54. As a result, the sheet P is smoothly conveyed toward the downstream side.

Conventionally, the height of the upstream side end of the upper surface 53*a* of the conveying guide 53 which is closest to the drum 51 and to the transfer roller 52 is substantially the same as the height of the end of the sheet which has just been separated from the drum surface on the path R', so that the end of the sheet separated from the drum surface is smoothly moved onto the upper surface 53*a* of the conveying guide 53.

However, in the conventional arrangement where the height of the upstream side end of the upper surface 53*a* of the conveying guide 53 is substantially the same as the height of the path R', the sheet P is pressed and rubbed against the guide ribs 54 formed on the conveying guide 53 just after the toner image is transferred thereonto, so that the rubbed portion is highly charged due to friction.

At this time, since the sheet P has just been charged at the time of transfer, the charge thereon is substantially maximum. Under such a condition, the toner forming an un-fixed image on the sheet P is strongly attracted by the charged areas of the sheet P rubbed against the guide ribs 54. As a result, traces of the ribs 54 are formed on the image. When the electric resistance of the resin material of which the conveying guide 53 is made is lower than the resistance of the sheet P, rib trances are formed more conspicuously since the charge is accumulated more easily in the conveying guide 53.

In addition, the portion of the sheet P adhering to the drum surface always receives a reaction force from the preceding part of the sheet separated from the drum surface since the preceding part is strongly rubbed against the conveying guide 53. When the image transfer onto the rear end of the sheet P is performed, the area of the sheet P adhering to the drum surface is small, so that the rear end of the sheet P is slightly shifted by the force received from the preceding part. As a result, the image is transferred onto an incorrect position in the rear end of the sheet P.

SUMMARY OF THE INVENTION

An object of the present invention is to prevent an unfixed toner image on the sheet from being disturbed by the charging of the conveying guide due to the friction between the conveying guide and the transfer sheet having just been separated from the transfer section.

To achieve this object, according to the present invention, the conveying guide for conveying the transfer sheet onto which an image has been transferred is arranged to be sufficiently lower than the position at which the sheet is separated from the drum surface. Further, the conveying guide has an electric resistance higher than the resistance of the transfer sheet.

After being separated from the drum surface, the transfer sheet is conveyed above the conveying guide without being in contact therewith, and is then bent downward by gravity to be in contact with the upper surface of the conveying guide at the middle and rear parts of the conveying guide. The charge of the sheet P is not easily transferred during that time since the conveying guide has a resistance higher than the resistance of the sheet as well as the charge of the sheet is largely reduced. Thus, the image is not disturbed by the generation of rib traces in the transferred image on the sheet due to the charging of the guide ribs caused by the friction between the guide ribs and the sheet.

Further, since the sheet is not in contact with the upper surface of the conveying guide until it reaches the middle part of the upper surface, the shock caused when the rear end of the sheet is separated from the photoreceptor drum is greatly relieved. As a result, the image is prevented from being transferred onto an incorrect position of the sheet.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
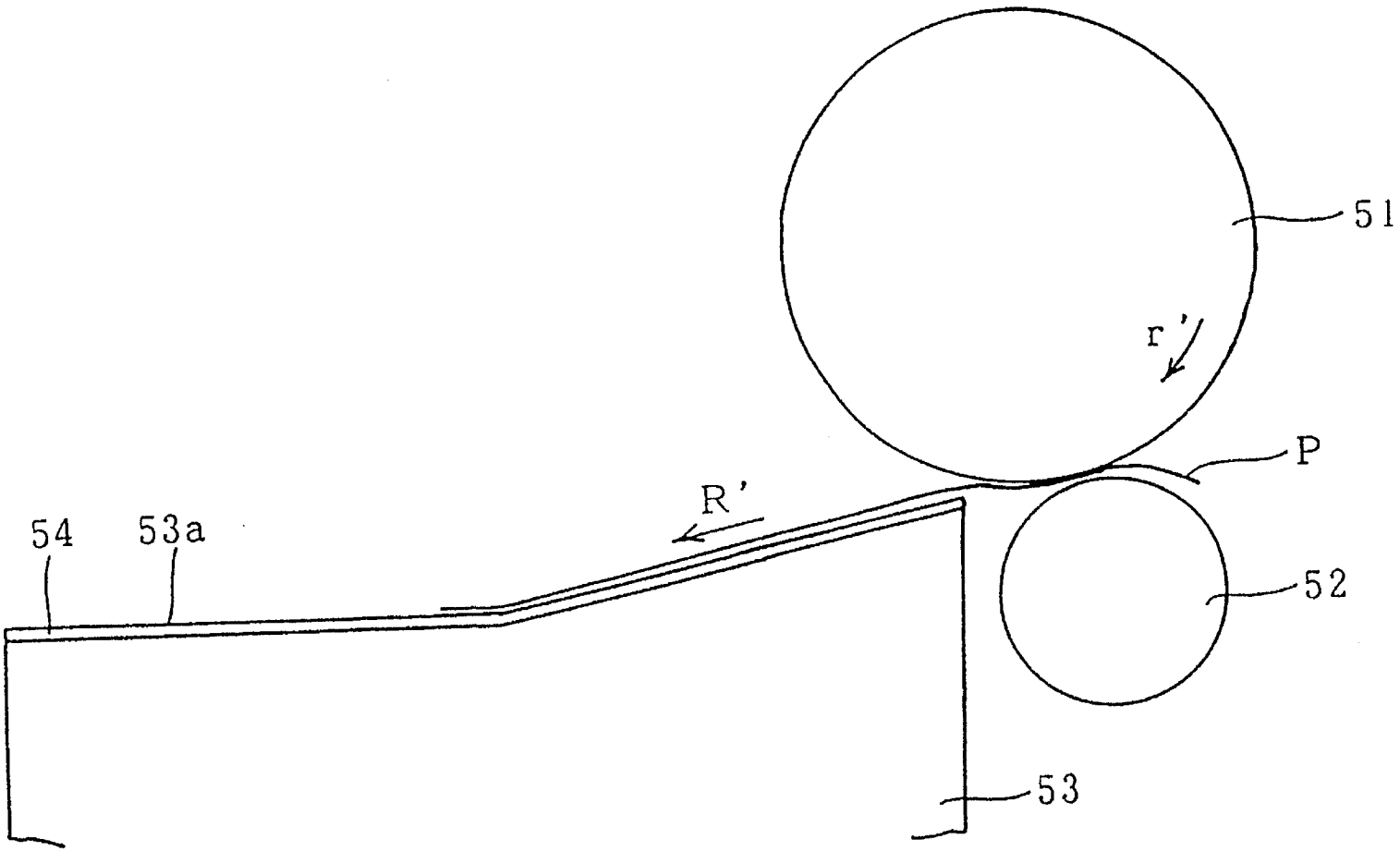
Fig. 1 Prior Art
FIG. 1 is a front view schematically showing a conventional transfer section.
Figure 2:
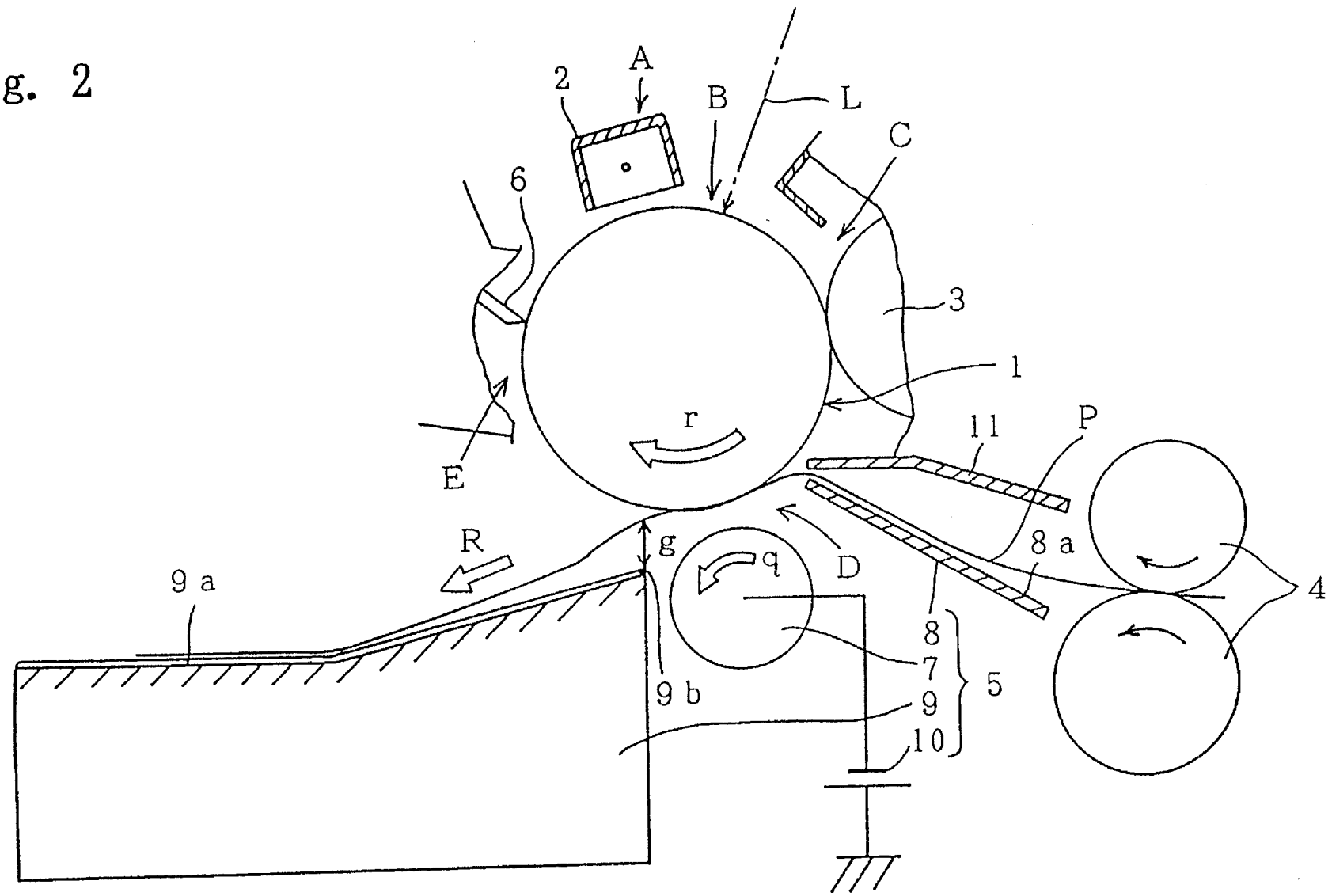
FIG. 2 is a front view schematically showing an embodiment of the present invention.

Hereinafter, an embodiment of the present invention employed in an electrographic copying machine will be described with reference to FIGS. 2 and 3. Referring first to FIG. 2, there is schematically shown a relevant portion of the copying machine. Reference numeral 1 represents a photoreceptor drum which comprises a tube made of a metal such as aluminum on which a photosensitive layer made of amorphous silicon (a-Si) or other photosensitive material is formed. The photoreceptor drum 1 is arranged substantially horizontally in the body of a copying machine (not shown), and is rotated at a predetermined speed in a direction (direction of arrow r) corresponding to a conveying direction of a transfer sheet P conveyed along a sheet path R.

Around the photoreceptor drum 1, a charging section A, an exposure section B, a development section C, a transfer section D and a cleaning section E are arranged in this order in the direction of rotation of the drum 1. In the charging section A, an appropriate charger 2 such as a corona discharger is arranged to face to the drum surface. The photosensitive layer on the drum surface is charged by the charger 2. When the drum 1 is rotated to the exposure section B, reflected light L of an original image read by a non-illustrated exposure optical system is irradiated onto the charged photosensitive layer of the drum surface to thereby form an electrostatic latent image of the original image on the drum surface. In the development section C, a developer unit 3 is provided. When the drum surface is moved to the development section C, the developer unit 3 applies charged toner of a polarity reverse to that of the electrostatic latent image onto the electrostatic latent image on the drum surface to form a toner image.

Reference numeral 4 represents resist rollers arranged at the end of a paper feeding mechanism. The resist rollers 4 are driven at a predetermined timing associated with the driving of the drum 1 and other driving systems, and convey the sheet P to the transfer section D. In the transfer section D, a transfer unit 5 is arranged to face to the drum surface. The toner image formed on the drum surface at the development section C is transferred onto the surface of the sheet P conveyed to the transfer section D through the resist rollers 4.

After the transfer, residual toner on the drum surface is removed by a cleaning unit 6 provided in the cleaning section E. Then, the charge on the drum surface is removed in a charge removing section (not shown) provided at an appropriate position opposite the drum surface, so that the photoreceptor drum 1 is ready for the next charging. The sheet P onto which the toner image of the original image has been transferred is pressurized and heated by a fixing unit (not shown) arranged in the downstream side of the sheet conveying direction, thereby fixing the toner to the sheet to complete the copying process.

The transfer unit 5 includes a transfer roller 7 serving as a charge supplying means, sheet conveying guides 8 and 9 arranged in the upstream side and the downstream side of the transfer roller 7, respectively, and a power source 10 for supplying a voltage for transfer.

The transfer roller 7 is arranged below the drum 1 to face thereto so that a gap greater than the thickness of the sheet is left between the drum surface and the periphery of the roller 7. The transfer roller 7 is made of a conductive resin material such as urethane resin or silicone resin in which carbon or an alkali metal is mixed, or of a conductive rubber material.

During transfer, the transfer roller 7 is rotated in a direction shown by arrow q corresponding to the direction of rotation of the drum 1, and a voltage of a polarity reverse to that of the toner image on the drum surface is applied to the transfer roller 7 to thereby transfer the charged toner attached to the drum surface in the development section C onto the sheet P. The length of the transfer roller 7 is equal to or greater than the axial length of the toner image formed area on the drum surface.

The upstream side conveying guide 8 is arranged between the transfer roller 7 and the resist rollers 4. An upper surface **8*a* thereof serves as a guide surface which defines the lower limit of the path R. The height of an end of the conveying guide 8 which faces the resist rollers 4 is substantially the same as the height of the nipping portion of the rollers 4**, and the other end ascends toward the drum surface.

Above the upstream side conveying guide 8, a cover 11 is arranged to face to the guide 8. The cover 11 is provided to prevent the sheet P conveyed along the guide 8 from recklessly moving upward. It also prevents the toner from dropping from the developer unit 3 adheres to the sheet P.

Figure 3:
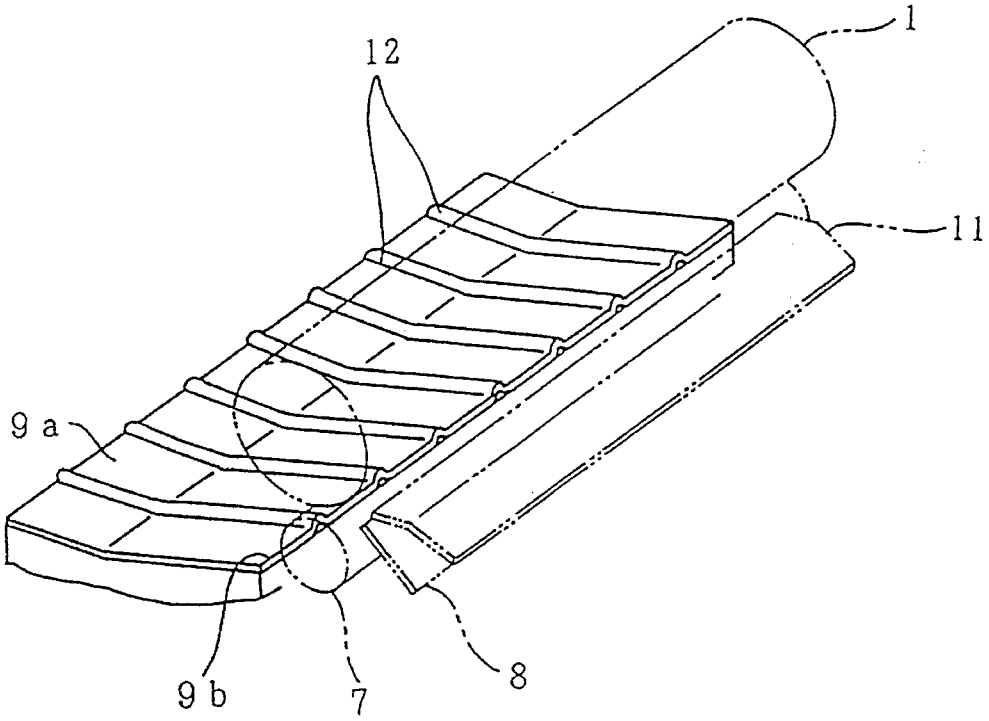
FIG. 3 is a perspective view schematically showing a conveying guide used in the embodiment of the present invention.

Referring to FIG. 3, there is schematically shown the downstream side conveying guide 9. As shown in this figure, the conveying guide 9 is arranged in the downstream side of the position at which the drum 1 and the transfer roller 7 face each other. An upper surface **9*a* of the conveying guide 9 serves as a sheet guiding surface which defines the lower limit of the path R. The upstream side half of the upper surface 9*a* gently declines in the sheet conveying direction, and the downstream side half thereof is substantially level. On the upper surface 9*a* of the conveying guide 9 are arranged a plurality of guide ribs 12** each having a semicircular section and formed to extend from the upstream side end to the downstream side end.

Returning to FIG. 2, the resist rollers 4 are driven in synchronism with the rotation of the photoreceptor drum 1, thereby feeding the sheet P at a speed equal to the peripheral speed of the drum surface. The sheet P is then led to the upper surface of the upstream side conveying guide 8 and passes through the gap between the transfer roller 7 and the drum 1. When passing through the gap, the sheet P is in close contact with a predetermined area (transfer area) on the drum surface without being in contact with the periphery of the transfer roller 7.

At this time, a voltage of a polarity reverse to that of the charged toner adhering to the drum surface is applied to the transfer roller 7 by the power source 10. By the Coulomb's force generated thereby, the charged toner adhering to the drum surface is transferred onto the transfer sheet P. It is considered that the reason why transfer is excellently performed although the sheet P is not in contact with the transfer roller 7 is that in the transfer area, a slight corona discharge is generated from the transfer roller 7 to the reverse surface of the sheet P.

Then, the sheet P onto which the toner image has been transferred is separated from the drum surface, and conveyed to the fixing unit by way of the upper surface 9*a* of the downstream side conveying guide 9. In this case, the sheet P is separated from the surface of the drum 1 by curvature separation. As well known, the curvature separation is a sheet separating method using the curvature of the drum 1 and the resiliency of the sheet P. The sheet P electrostatically adhering to the drum 1 is separated spontaneously because of its resiliency when it reaches a separation position where the sheet P is located slightly higher than the horizontal tangential line of the drum 1 in the downstream side of the conveying direction. In this embodiment, the curvature of the drum 1 is set to a value which enables the curvature separation.

After the sheet P electrostatically adhering to the transfer area on the drum surface which faces to the transfer roller 7 is separated from the drum surface in this manner, the path along which the sheet P is conveyed to the upper surface 9*a* of the guide 9 is dependent on the position of separation of the sheet P from the drum 1 and on the resiliency of the sheet P. In this embodiment, an upstream side end 9*b* of the upper surface 9*a* of the conveying guide 9 is located lower than the path along which the sheet P is conveyed. Specifically, an appropriate size of a gap g between the upstream side end 9*b* and the path along which the sheet P is conveyed is approximately 1 mm to 3 mm.

Further, at least the upper surface 9*a* of the downstream side conveying guide 9 is made of an insulating material such as an insulating synthetic resin. In this case, the downstream side conveying guide 9 is made of a material having an electric resistance higher than the resistance of the sheet P. Specifically, since the resistance of the sheet P is $10^{10}\Omega$ to $10^{13}\Omega$, the downstream side conveying guide 9 is made of a popular ABS resin having a high resistance of approximately $10^{14}\Omega$.

In recent years, in some copying machines, the downstream side conveying guide 9 is made of an anti-electrostatic ABS resin having a resistance of approximately $10^{12}\Omega$. In this case, however, when a sheet P having a resistance higher than that of the upper surface 9*a* of the guide 9 is in contact with the upper surface 9*a*, the charge on the sheet P is accumulated in the downstream side conveying guide 9.

On the contrary, in this embodiment, since the resistance of the downstream side conveying guide 9 is higher than that of the sheet P, the charge on the sheet P is not accumulated in the guide 9 even if the surface resistance of the sheet P increases due to an environmental change such as a temperature increase around the drum 1.

In this embodiment having the above-described structure, since the upstream side end 9*b* of the upper surface 9*a* of the conveying guide 9 is located lower than the path along which the sheet P is conveyed, immediately after the sheet P is separated from the drum surface, i.e. when the sheet P is most highly charged, the sheet P descends along the path P which depends on the resiliency of the sheet P without being in contact with the upper surface 9*a*. As a result, the sheet P is in contact with the upper surface 9*a* at the middle and rear parts of the upper surface 9*a*.

The sheet P is largely reduced in charge between its separation from the drum surface and its contact with the upper surface 9*a*. Further, since the resistance of the downstream side conveying guide 9 is higher than that of the sheet P, the charge of the sheet P is not easily transferred to the downstream side conveying guide 9. As a result, the charging of the guide ribs 12 due to the friction between the sheet P and the guide ribs 12 which is the cause of the generation of rib traces in the transferred image on the sheet P is prevented to the utmost.

In addition, since the sheet P is not in contact with the upper surface 9*a* until it reaches the middle part of the surface 9*a*, the shock caused when the rear end of the sheet P is separated form the drum 1 is effectively relieved. As a result, the image is prevented from being transferred onto an incorrect position in the rear end of the sheet P.

Figure 4:
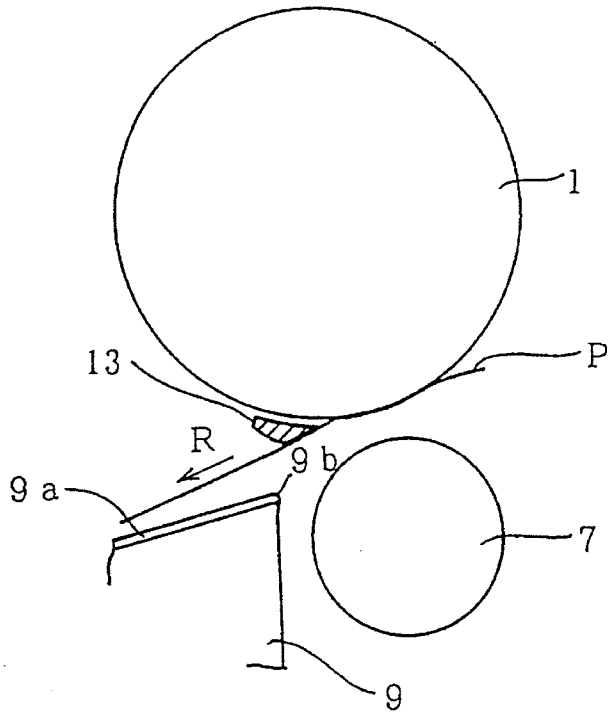
FIG. 4 is a front view schematically showing an example of another means for separating the sheet.

While the curvature separation is used as the sheet separating method in this embodiment, a claw separation as shown in FIG. 4 may be used. In the arrangement shown in FIG. 4, a separating claw 13 substantially in contact with the drum surface is arranged at the separation position on the drum surface in the downstream side of the conveying direction, and the sheet P electrostatically adhering to the drum surface is forcibly separated therefrom by the separating claw 13.

In this case, since the upstream side end 9*b* of the upper surface 9*a* of the conveying guide 9 is located lower than the path along which the sheet P is conveyed, the shock is effectively relieved which works from the preceding part of the sheet P on the position of the separation by the claw 13 when the rear end of the sheet P is separated from the drum 1.

While the transfer roller 7 supplies the charge without being in contact with the drum surface in this embodiment, a widely-used transfer roller which is always in contact with the drum surface or a transfer charger such as a corona discharger may be used. While the rotary drum is used as the photoreceptor in this embodiment, an endless belt type photoreceptor which circularly moves may be used.

As described above, according to the present invention, since the resistance of the conveying guide for conveying the sheet onto which an image has been transferred is higher than the resistance of the transfer sheet, the guide ribs on the conveying guide are prevented from being charged due to the friction between the sheet and the ribs, so that the generation of rib traces on the sheet is prevented to the utmost. Since the upstream side end of the upper surface of the conveying guide is located lower than the path along which the sheet is conveyed to the upper surface of the conveying guide, the charge of the sheet is reduced before it is brought into contact with the conveying guide, so that the above-mentioned advantage is more remarkable. Thus, the transferred image is maintained in an excellent condition until it is fixed.

Further, since the sheet is not in contact with the upper surface of the conveying guide until it reaches the middle part of the upper surface, the shock caused when the rear end of the sheet is separated from the photoreceptor drum is greatly relieved. As a result, the image is prevented from being transferred onto an incorrect position.

Obviously, many modifications and variations of the present invention are possible in light of the above teachings. It is therefore to be understood that within the scope of the appended claims, the invention may be practiced other than as specifically described.

What is claimed is:

1. An image forming apparatus comprising:

an image carrier having a moving surface for carrying an image formed by charged toner;

transferring means for transferring a toner image carried on the image carrier onto a transfer sheet adhering to the moving surface of the image carrier, the transferring means being arranged below the image carrier; and a sheet conveying guide for conveying a transfer sheet onto which an image has been transferred by the transferring means, the sheet conveying guide having an electric resistance higher than an electric resistance of the transfer sheet, a plurality of guide ribs formed along an upper surface of the sheet conveying guide in a direction in which the transfer sheet is conveyed, the plurality of guide ribs serving as a conveying path for the transfer sheet, and an upstream end, the upstream end of the upper surface being located lower than a position at which the transfer sheet is separated from the moving surface of the image carrier, such that a difference between a height of the upstream end of the upper surface and a height of the position at which the transfer sheet is separated from the surface of the image carrier is at least 1 mm and at most 3 mm.

2. An image forming apparatus according to claim 1, wherein the surface of the image carrier has, at least at a downstream side of the transferring means, a curvature which enables a curvature separation of the transfer sheet adhering to the moving surface of the image carrier from contact with the moving surface of the image carrier.

3. An image forming apparatus according to claim 1, further including a separating claw for separating the transfer sheet adhering to the moving surface of the image carrier from the moving surface of the image carrier, the separating claw being arranged at a downstream side of the transferring means.

4. An image forming apparatus according to claim 1, wherein said transferring means includes a transfer roller.

5. An image forming apparatus according to claim 1, wherein the transferring means is arranged relative to the image carrier such that the image carrier and the transferring means are separated by a gap larger than a thickness of the transfer sheet.

6. An image forming apparatus comprising:

an image carrier having a moving surface for carrying an image formed by charged toner;

transferring means for transferring a toner image carried on the image carrier onto a transfer sheet adhering to the moving surface of the image carrier, the transferring means being arranged below the image carrier; and a sheet conveying guide for conveying a transfer sheet onto which an image has been transferred by the transferring means, the sheet conveying guide having an electric resistance higher than an electric resistance of the transfer sheet, a plurality of guide ribs formed along an upper surface of the sheet conveying guide in a direction in which the transfer sheet is conveyed, the plurality of guide ribs serving as a conveying path for the transfer sheet, and an upstream end, a middle portion, and a downstream end, the upstream end being located lower than a position at which the transfer sheet is separated from the moving surface of the image carrier such that the transfer sheet first contacts the sheet conveying guide at the middle portion or at the downstream end; and a difference between a height of an upper surface of the upstream end of the sheet conveying guide and a height of the position at which the transfer sheet is separated from the surface of the image carrier is at least 1 mm and at most 3 mm.

7. An image forming apparatus according to claim 6, wherein the surface of the image carrier has, at least at a downstream side of the transferring means, a curvature which enables a curvature separation of the transfer sheet adhering to the moving surface of the image carrier from contact with the moving surface of the image carrier.

8. An image forming apparatus according to claim 6, further including a separating claw for separating the transfer sheet adhering to the moving surface of the image carrier from the moving surface of the image carrier, the separating claw being arranged at a downstream side of the transferring means.

9. An image forming apparatus according to claim 6, wherein said transferring means includes a transfer roller.

10. An image forming apparatus according to claim 6, wherein the transferring means is arranged relative to the image carrier such that the image carrier and the transferring means are separated by a gap larger than a thickness of the transfer sheet.

* * * * *